US010697199B2

(12) United States Patent
Hellenbrand

(10) Patent No.: US 10,697,199 B2
(45) Date of Patent: Jun. 30, 2020

(54) STABLE, NON-LOCKING PICKET FENCE SYSTEM

(71) Applicant: Shawn Hellenbrand, West Allis, WI (US)

(72) Inventor: Shawn Hellenbrand, West Allis, WI (US)

( * ) Notice: Subject to any disclaimer, the term of this patent is extended or adjusted under 35 U.S.C. 154(b) by 419 days.

(21) Appl. No.: 15/637,802

(22) Filed: Jun. 29, 2017

(65) Prior Publication Data

US 2018/0320404 A1 Nov. 8, 2018

Related U.S. Application Data

(60) Provisional application No. 62/502,752, filed on May 7, 2017.

(51) Int. Cl.
*E04H 17/14* (2006.01)
*E04H 17/16* (2006.01)
*E04H 17/00* (2006.01)

(52) U.S. Cl.
CPC ..... *E04H 17/1439* (2013.01); *E04H 17/1417* (2013.01); *E04H 17/1443* (2013.01); *E04H 17/16* (2013.01); *E04H 17/00* (2013.01); *E04H 2017/006* (2013.01); *E04H 2017/1447* (2013.01)

(58) Field of Classification Search
CPC ..... E04H 17/1417; E04H 17/1439; E04H 17/1443; E04H 17/16; E04H 17/165; E04H 17/166; E04H 2017/006; E04H 2017/1447
See application file for complete search history.

(56) References Cited

U.S. PATENT DOCUMENTS 4,995,591 A * 2/1991 Humphrey ..... B21F 29/02 256/19
5,150,885 A * 9/1992 Leone ..... E04H 17/1439 256/22
5,702,090 A * 12/1997 Edgman ..... E04H 17/1421 256/19
5,988,599 A * 11/1999 Forbis ..... E04H 17/1417 256/24
6,053,480 A * 4/2000 De Guise ..... E04F 11/181 256/22
6,375,166 B1 * 4/2002 Schall ..... E04H 17/1439 256/21

(Continued)

*Primary Examiner* — Jonathan P Masinick
(74) *Attorney, Agent, or Firm* — Mark A. Littman & Associates, P.A.

(57) ABSTRACT

A fencing system has at least two engaging elements, two rails extending along respective upper and lower rail axes with a generally hollow rectangular or four-sided cross-section. The rails have a horizontal top wall between first and second vertical rail sidewalls that depend downwardly to define an internal cavity. At least two attachment legs extend inwardly towards each other from the sidewalls. Vertical picket posts extend between through holes in the upper and lower horizontal rails. The picket post includes multiple grooves. The grooves receive the posts without penetration into any internal cavities of the upper and lower rail, and the posts are forced inwardly into the grooves by elastic memory in the sidewalls, the posts within grooves not being in locked engagement with the grooves, but held in place by the force of the elastic memory, the posts withdrawable from the grooves by overcoming the elastic force.

20 Claims, 7 Drawing Sheets

(56) References Cited

U.S. PATENT DOCUMENTS 6,752,386 B1 * 6/2004 Bundy ..... E04H 17/1439 256/22
6,796,549 B1 * 9/2004 Lester ..... E04H 17/1439 256/22
6,811,145 B2 * 11/2004 Gibbs ..... B21F 27/10 256/21
7,152,849 B2 * 12/2006 Graber ..... E04H 17/1443 256/22
7,621,510 B2 * 11/2009 Gibbs ..... E04H 17/1439 256/22
7,744,065 B2 * 6/2010 Terrels ..... H02G 3/0456 256/59
8,403,303 B2 * 3/2013 Payne ..... E04H 17/1443 256/22
8,511,648 B2 * 8/2013 McCarthy ..... E04H 17/1439 256/67
9,435,134 B2 * 9/2016 Walmsley ..... E04H 17/1439
9,797,158 B2 * 10/2017 Springborn ..... E04F 11/1817
2008/0023684 A1 * 1/2008 Diamond ..... E04H 17/161 256/1
2009/0065755 A1 * 3/2009 Sherstad ..... E04H 17/1417 256/22
2010/0237308 A1 * 9/2010 Lo ..... E04H 17/1417 256/26
2010/0264388 A1 * 10/2010 Duffy ..... E04H 17/1439 256/22
2011/0155982 A1 * 6/2011 Duffy ..... E04H 17/1439 256/22
2013/0264532 A1 * 10/2013 Goodman ..... E04H 17/1439 256/65.08
2014/0034890 A1 * 2/2014 Dixon ..... E04H 17/1439 256/72
2015/0021534 A1 * 1/2015 Molina ..... E04H 17/1439 256/65.12
2016/0097216 A1 * 4/2016 Molina ..... E04F 11/1817 256/65.12
2018/0030754 A1 * 2/2018 Leone ..... E04H 17/1443
2018/0274262 A1 * 9/2018 Walker ..... E04H 17/1439

* cited by examiner

STABLE, NON-LOCKING PICKET FENCE SYSTEM

RELATED APPLICATION DATA

This application claims priority from U.S. Provisional Patent Application Ser. No. 62/502,752, filed 7 May 2017 titled STABLE, NON-LOCKING PICKET FENCE SYSTEM.

BACKGROUND OF THE INVENTION

1. Field of the Invention

The present invention relates to the field of fence systems such as decorative fences and picket fences. The invention further relates to methods or apparatuses used to construct associated with the fence systems.

2. Background of the Art

It is desirable to be able to provide quickly assembled and easily repaired, without the use of nails, screws or permanent adhesive.

U.S. Pat. No. 8,511,648 (McCarthy) discloses a fence system with an upper horizontal rail and a lower horizontal rail extending along respective upper and lower rail axes. Each of the rails has extruded plastic material including a horizontal top wall extending laterally between first and second vertical rail sidewalls that depend downwardly from opposed edges of the top wall to define an internal cavity. There are a plurality of attachment legs extending from a base surface and formed integrally with the sidewalls. Each attachment leg including a barb; a plurality of vertical members each extending between the upper and lower horizontal rails, each vertical member comprising at least one upper slot and at least one lower slot. The barbs are adapted to be received into the internal cavities of the upper and lower rails. Each of the attachment legs of the upper and lower rails is at least partially resilient to facilitate insertion of the attachment legs within respective ones of the slots when the vertical members are received into the internal cavities of the upper and lower rails. Each barb resists removal of the attachment leg once inserted into a corresponding slot to facilitate securement of each vertical member to the upper and lower horizontal rails. Each base surface is a surface of a base wall extending upwardly toward the top wall, and each of the attachment legs is cantilevered from a terminal end of one of the base walls; wherein each barb comprises an abutment surface that is offset from the base surface and that bears against an inner surface of the vertical member adjacent the respective slot into which the attachment leg is received when the attachment leg is fully inserted into the slot to inhibit removal of the attachment leg from the slot; and wherein each base surface engages an outer surface of one of the vertical members when each attachment leg is received in one of the slots. The barb locks the attachment legs so that they cannot be removed by withdrawal along the path they were inserted into the slots.

U.S. Pat. No. 5,702,090 (Edgman) discloses a plastic fence assembly formed of plural post members which are formed of hollow extruded plastic and have opposed side walls and end walls intersected by one or more elongated channels. Elongated spacer elements may be inserted in the channels and retained therein by interlocking projections on the spacer elements and recesses formed in the sidewalls of the post channels. The spacer elements support side edges of vertically extending picket members, brackets for horizontally extending center rail members and to position at least one or both of elongated top and bottom rail members of the fence assembly. The top and bottom rail members have elongated slots formed therein for receiving opposite ends of generally planar boardlike picket members. The top and bottom rail members and the spacer members may be cut to length as may the post and picket members to provide fencing of a desirable height and distance between posts.

U.S. Pat. No. 5,988,599 (Forbis) discloses a modular fence system. The system includes fence planks designed for insertion into open channels of upper and lower fence rails. The fence rails are supported in a horizontal orientation between intermittent fence posts, with the fence planks extending vertically between the rails. The planks include resilient protrusions at their upper ends. The protrusions of the planks are designed to fit into internal passages formed in the open channels of the upper fence rail, into engagement with ledges defining the passages, to inhibit inadvertent removal of the planks from the upper rail.

U.S. Pat. No. 6,478,287 (DeSouza) discloses a fence panel constructed from extruded hollow polyvinyl plastic boards. The boards are arranged with vertical end boards and filler boards between the end boards. Three horizontal rails each have a board on each side of the vertical boards with a horizontal filler board between the top rail boards to seal off the upper ends of the vertical boards. All of the boards are secured together with a plastic adhesive without the use of any mechanical fasteners.

U.S. Patent application publication 2008/0217598 (Dombroski) discloses a fence assembly that is made up of a plurality of fence sections. Each section is made up of panels with top, bottom and side edges and front and rear surfaces. Slots are spaced from and milled into the panels along one of the sets of edges. A pair of trim extends over and covers the set edges and each trim has projections that snap or slide into the front and rear slots. Alternatively the edges of the panel may be beaded and slid over the slotted side of the trim. The fence sections are coupled pivotably to fence posts such that the panels may pivot, under force of wind, about either their top or bottom end. The panels are restored to generally vertical position by the force of gravity. A counterweight within the fence post linked to the panels can be used to restore panels to their vertical position. In an alternate embodiment, the brackets coupling the panels to the fence posts may slide along the fence posts and the panels bow in response to high winds. The fence panels may include resilient strips along their vertical edges.

U.S. Patent application 2008/0023684 (Diamond et al.) discloses a non-metallic fence system that has a singular snap lock mechanism for permitting the easy construction of the fence. It also includes a securing device for fixing a fabric to a fence having a rigid body including at least two prongs therefrom and an open face strut profile capable of receiving the prong therein, wherein the prongs are locked within the open face and the fixture can be removed by twisting 90 degrees.

SUMMARY OF THE INVENTION

A fence system has at least two engaging elements, an upper horizontal rail and a lower horizontal rail extending along respective upper and lower rail axes. Each of the rails has a respective extended plastic material including a horizontal top wall extending laterally between first and second vertical rail sidewalls that depend downwardly from opposed edges of the top wall to define an internal cavity. At least two attachment legs each extend inwardly towards each other from a lower portion of the sidewalls, and each attachment leg including a post. A plurality of vertical picket posts extend between the upper and lower horizontal rails. Each picket post includes at least one upper groove and at least one lower groove on opposed exterior surfaces of the picket posts. The grooves need not form holes through the surfaces of the picket posts and preferably do not form openings but only surface grooves. The grooves are adapted to receive the posts without penetration into any internal cavities of the upper and lower rail (which may be hollow or solid. Each of the attachment legs of the upper and lower rails may be rigid or at least partially resilient to facilitate insertion of the attachment legs into respective ones of the grooves. The grooves have a base surface within the grooves, and the posts extend towards or contact the base surface. The posts are forced inwardly into the grooves, and if the posts are long enough, will contact the base surface. The force on the posts is created by elastic memory in the first and second vertical rail sidewalls. The sidewalls may be angled, curved or otherwise formed so that the posts are positioned against the entrance to the grooves, the posts are forced into the grooves. The posts are not in locked engagement with the grooves, but are held in place by the force of the elastic memory, and the posts can be withdrawn from the groove solely by overcoming the elastic force. The sidewalls will deflect outwardly with that force withdrawn the posts from the grooves. There is no withdrawing resistance of the posts in the grooves except for sidewall elastic memory resistance and surface to surface friction of the posts against the sides of the groove. There are no features on the posts that should snag or lockingly engage with notches, ridges or distal surfaces in the groove. When the picket posts are slide through the upper and lower horizontal rails, the posts will engage the grooves and stabilize the picket posts within the two horizontal rails. The posts may be removed from the pickets by pulling the sidewalls away from each other, disengaging the posts from the grooves. By not having the posts locked into grooves or slots.

DETAILED DESCRIPTION OF THE INVENTION

Figure 1:
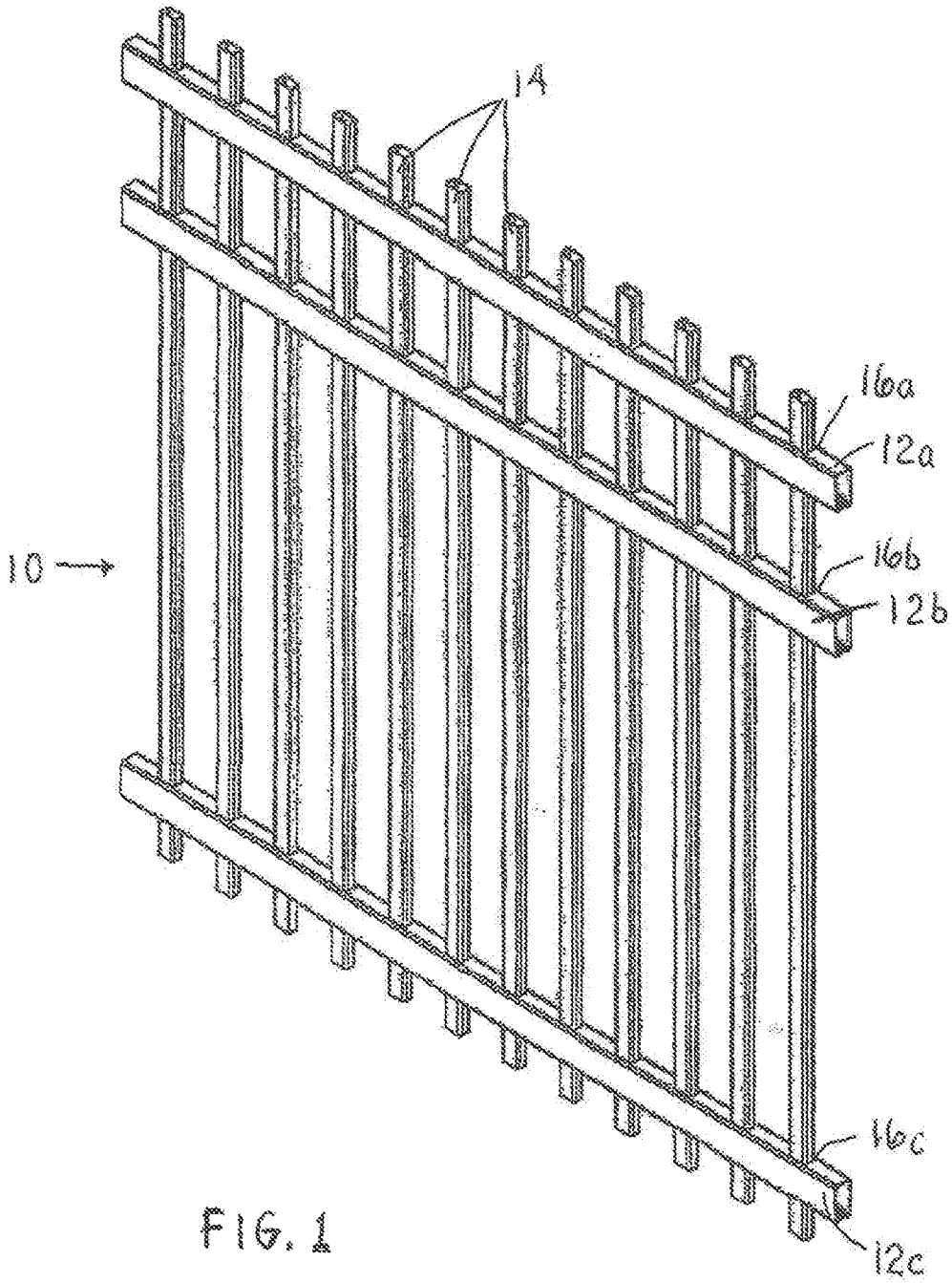
FIG. 1 shows a perspective view of fence system having three horizontal rails and multiple picket posts passing through the horizontal rails.

The present invention includes both methods and articles. In one sense, a general description of a fence system is one which may include:

at least two engaging elements, an upper horizontal rail and a lower horizontal rail extending along respective upper and lower rail axes;

each of the upper horizontal rails and the lower horizontal rail has a respective extended plastic material including a horizontal top wall extending laterally between first and second vertical rail sidewalls that depend downwardly from opposed edges of the top wall to define an internal cavity;

at least two attachment legs each extend inwardly towards each other from a lower portion of the sidewalls, and each attachment leg including a post having a tip;

a plurality of vertical picket posts extend between through holes in the upper and lower horizontal rails;

each picket post includes at least one upper groove and at least one lower groove on opposed exterior surfaces of the picket posts;

the grooves receive the posts without penetration into any internal cavities of the upper and lower rail;

the grooves have a base surface within the grooves, and the tips of the posts extend towards or into contact with the base surface;

the posts are forced inwardly into the grooves by elastic memory in the sidewalls, the posts within grooves not being in locked engagement with the grooves, but held in place by the force of the elastic memory, the posts withdrawable from the grooves by overcoming the elastic force.

The fence system may be designed wherein the vertical rail sidewalls are bowed so that the posts are positioned towards each other at bottoms of the attachment legs. By being bowed, a middle portion of the two vertical sidewalls first extend away from each other and then curve or bend so that the two vertical sidewalls extend towards each other. The fence system may be otherwise constructed wherein bottoms of the vertical rail sidewalls are slanted inwardly so that the posts are positioned towards each other on the attachment legs. The fence system may be constructed wherein there are no one upwardly or downwardly reversing slopes from the tips, or wherein there is at least one upwardly or downwardly reversing slope from the tips that assists in guidance of the posts into the grooves. The at least one slope described above may have a length to its end away from the tip so that when the tip contacts the base surface of the groove, the end of the slope away from the tip extends above an outside edge of the groove. The length may extend exactly to the outside edges of the groove and may even slide into the groove, but without creating any significant locking resistance other than friction against sides of the groove. In this style of fence system, withdrawal of the posts from the grooves can be accomplished by overcoming only the elastic memory and incidental friction between the posts and sides of the grooves.

The fence system may be constructed where there is at least one upwardly or downwardly reversing slope from the tips that assists in guidance of the posts into the grooves.

A method of assembly a readily disassemblable fence system includes a) at least three engaging elements, an upper horizontal rail and a lower horizontal rail extending along respective upper and lower rail axes, and each of the upper horizontal rails and the lower horizontal rail having through holes; and b) at least one vertical picket post that is sized to extend between the through holes in the upper and lower horizontal rails;

each of the upper horizontal rails and the lower horizontal rail has a respective extended plastic material including a horizontal top wall extending laterally between first and second vertical rail sidewalls that depend downwardly from opposed edges of the top wall to define an internal cavity, and at least two attachment legs each extend inwardly towards each other from a lower portion of the sidewalls, and each attachment leg including a post having a tip. The method includes inserting the at least one vertical picket post so that the at least one vertical picket post extends between both of the through holes in the upper horizontal rails and the lower horizontal rails. Each picket post includes at least one upper groove and at least one lower groove on opposed exterior surfaces of the picket posts. The method continues by aligning the posts on at least one of the first and second vertical side walls (preferably on both of the first and second vertical side walls) so that grooves receive the posts without penetration into any internal cavities of the upper and lower rail. This alignment forces the posts inwardly into the grooves by elastic memory in the sidewalls, the posts within grooves remaining slideable out of the grooves and not being in any locked engagement with the grooves, being held in place by the force of the elastic memory and being withdrawable from the grooves by overcoming the elastic force, and minimal friction of the tip against sides of the groove as the tips are withdrawn. The vertical rail sidewalls may be bowed and the posts are positioned towards each other at bottoms of the attachment legs.

The bottoms of the vertical rail sidewalls may be slanted inwardly and the posts are thereby positioned towards each other on the attachment legs by the inward slant.

The method may be practiced wherein there are no upwardly or downwardly reversing slopes from the tips. The method may continue during a repair situation, for example, wherein after assembling the fence system, the at least one vertical post is separated from at least one of the horizontal rails by a force overcoming inwardly stabilizing elastic memory and removing the posts from the grooves without damaging the posts.

According to one aspect of the invention, the fence system includes a first extruded straight picket post element that extends lengthwise along a first longitudinal axis. The first picket post element has a sidewall with at least a first slot in the sidewall and the first slot extends generally perpendicular to the longitudinal axis. The fence system also includes a second extruded rail element extending lengthwise along a second longitudinal axis. The second extruded (it need not be extruded, but could be molded, three dimensionally printed, hot pressed, cold pressed or the like, so "extruded" is used in a general sense, not a highly limiting sense) rail element includes at least a corresponding first attachment leg extending outward from the second extruded rail element and parallel to the second longitudinal axis. The first attachment leg is integrally extruded with the second extruded rail element and is received in the first slot to secure together the first and second rail elements. In some examples, the vertical members (the picket posts are generally referenced) can be in the form of fence panels, pickets, boards, or slats. The vertical members and/or the rails can, in some examples, be formed of plastic and can be injection molded. In some examples, each vertical member comprises an extruded polymeric or composite material, made of, for example, but not limited to, a thermoplastic or thermoset resin plastic material. The upper and lower slots can comprise cuts (for example, saw cuts) or a similar material-removal feature in the picket posts. The slots can be parallel to, and spaced equally apart from, the upper and lower edges of panels.

In some examples, the rails can comprise extruded rail elements having a cavity therein. The rails can have a constant or variable cross-sectional profile along their length. The rails also can be made of a plastic or composite material. Each of the rails, including, for example, the first and second rails and an optional third rail may or may not have a common rail profile. In other words, a length of extruded lineal having the common rail profile can be used as any one of the first, second, or third rails.

In some examples, the front and/or back faces of fence panel can comprise one or more vertical channels extending along the height of the panel. The channel(s) can give the illusion that each panel comprises a plurality of slats. Each channel can comprise a channel face, and opposed lateral faces. The channel can have the same depth as each of the grooves, and each tongue can abut the channel face(s). In some examples, each fence panel is provided with cooperating male and female engagement elements, such that each fence panel may be connected to one or more other fence panels. The male and female engagement elements can be configured such that when a male engagement element is inserted into a female engagement element, the joint provides the appearance of a channel. For example, each female engagement element can comprise opposed walls, between which the male engagement element is inserted. The opposed walls can be provided at a distance from the front and back faces of the panel, respectively, that is equal to the depth of the channel(s), and the width of each opposed walls can be equal to the width of the channel face.

The sidewalls may deflect outwardly with that force used to withdraw the posts from the grooves. There is essentially no withdrawing resistance of the posts in the grooves except for sidewall elastic memory resistance and surface to surface friction of the posts against the sides of the groove (the surface to surface friction seldom if ever constituting more than 20% of the total force used to withdraw the posts from the grooves). There are no features on the posts that should snag or lockingly engage with notches, ridges or distal surfaces in the groove. When the picket posts are slide through the upper and lower horizontal rails, the posts will engage the grooves and stabilize the picket posts within the two horizontal rails. The posts may be removed from the pickets by pulling the sidewalls away from each other, disengaging the posts from the grooves. By not having the posts locked into grooves or slots.

Referencing the Figures will assist in a further understanding of the present invention and its distinctions from the prior art.

FIG. 1 shows a perspective view of fence system 10 having three horizontal rails 12*a*, 12*b*, and 12*c* and multiple picket posts 14 passing through the horizontal rails. There are respective holes 16*a*, 16*b* and 16*c* passing through the horizontal rails 12*a*, 12*b*, and 12*c* and through which the multiple picket posts 14 pass and engage.

Figure 2:
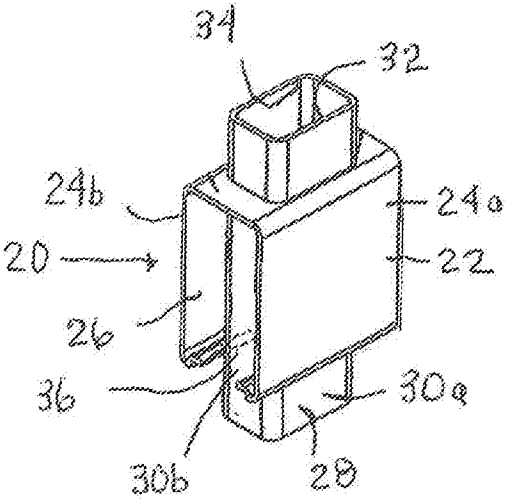
PRIOR ART FIG. 2
FIG. 2 shows a perspective cutaway view of a picket post passing through a horizontal rails and engaged therewith.

FIG. 2 shows a perspective cutaway view of a fence system engagement function 20 with a picket post 28 passing through a horizontal rail 22 and engaged therewith. There are two downward arms 24*a* and 24*b* on the horizontal rail 22. The picket post 28 has two opposed sides 30*a* and 30*b*. A groove 36 is shown in dash lines in opposed side 30*b*. The dash lines indicate that the groove (on the outside surface of opposed side 30*b* does not pass all the way through the opposed side 30, or is so narrow that any posts (not numbered, but shown in FIGS. 4A, 4B and 4C) on the horizontal rail cannot pass all the way through the opposed side 30*b*. The picket post 28 is shown forming a cavity 34 by the four walls 32. The groove 36 preferably does not create a hole or opening through any of the walls 32 of the picket post 28, which prevents any locking of the posts (not numbered) against any outside surface of the picket post 28, outside the cavity 34.

Figure 3:
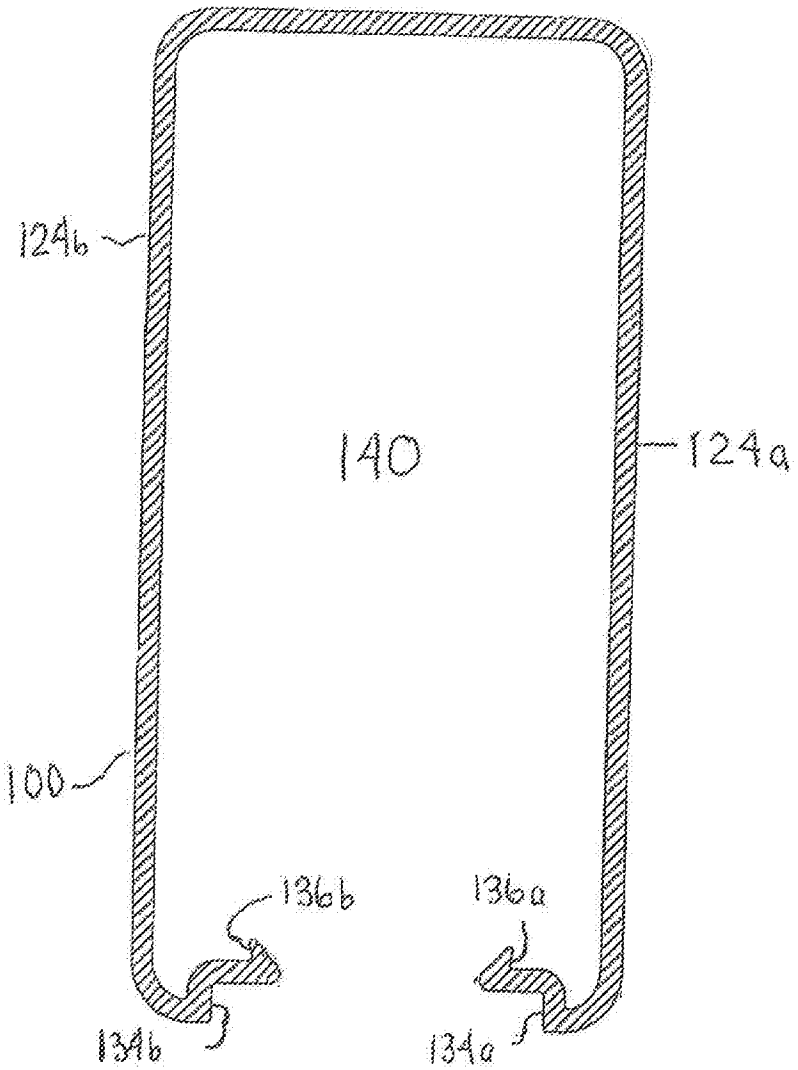
FIG. 3 PRIOR ART
FIG. 3 shows a cross-section view of a horizontal rail.

FIG. 3 shows a cross-section view of a horizontal rail 100. This horizontal rail design 100 may be used in the practice of the present invention, even though it is known in the prior art (e.g., U.S. Pat. No. 8,511,648, McCarthy), although alternative structures shown in FIGS. 4B and 4C are disclosed herein. When the horizontal rail structure of FIG. 3 is used in the present invention, it must be used with a groove such that barb elements 136*a* and 136 do not lock against an interior surface of a picket post by passing through a slot so that the barbs 136*a* and 136*b* do not abut or latch against an interior surface defining the cavity 34 in the picket post 28 (of FIG. 2). The two horizontal opposed sides 124*a* and 124*b* extend downwards to the posts 134*a* and 134*b* and the penetration legs 136*a* and 136*b* of the posts 134*a* and 134*b*, respectively. The two horizontal opposed sides 124*a* and 124*b* assist in defining a cavity 140.

Figure 3A:
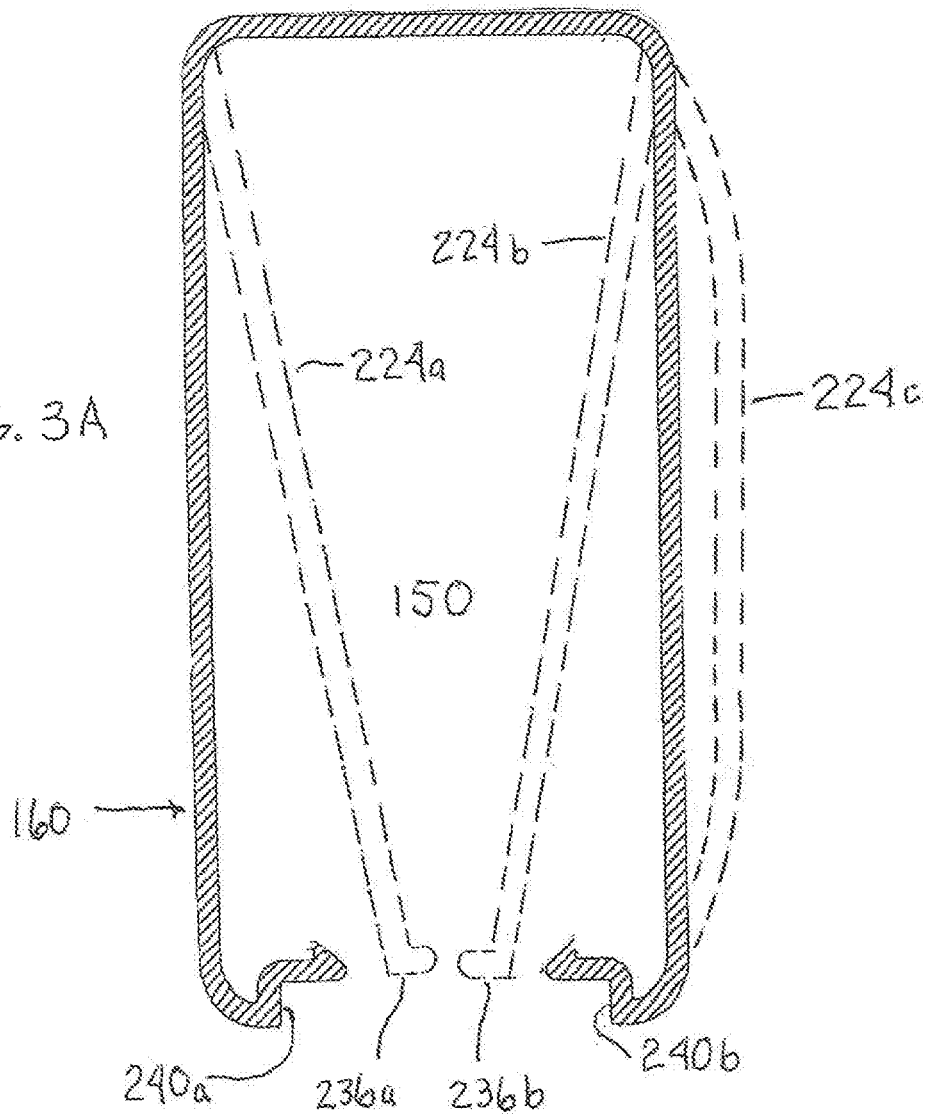
FIG. 3A shows a cross-section of three variants of horizontal rail constructions useful in the present invention.

FIG. 3A shows a cross-section of three variants of horizontal rail constructions 160 useful in the present invention. A cavity 150 is generally within the horizontal rail constructions 160. As opposed to the rather linear, rectangular (even with rounded corners) horizontal rail design of FIG. 3, Two preferred alternative structures according to the present invention are shown. A single horizontal rail downward side 224*c* is shown with a bow that assists in providing elastic memory to the horizontal sides 224. The downward (relatively vertical) side 224 may be connected to a post 240*b* with penetration legs at the shown position relatively in a same position as a rectangular (FIG. 3) configuration, or be more inwardly disposed, as with the slanted walls 224*a* and 224*b*. The slanted walls 224*a* and 224*b* are more inwardly disposed so that there is more tension when a picket post is inserted therebetween. The engagement legs (or posts when a single piece) 236*a* and 236*b* may have sloped bottoms to assist in direct pressure separation when a picket post (not shown) is pressed against the two posts 236*a* and 236*b*. There are optional abutment restrictors 240*a* and 240 shown at the base of the downward sides (for all post constructions). These can assist in limiting penetration of the posts into the grooves (not shown in this Figure) of the picket posts (not shown in this Figure).

Figure 4A:
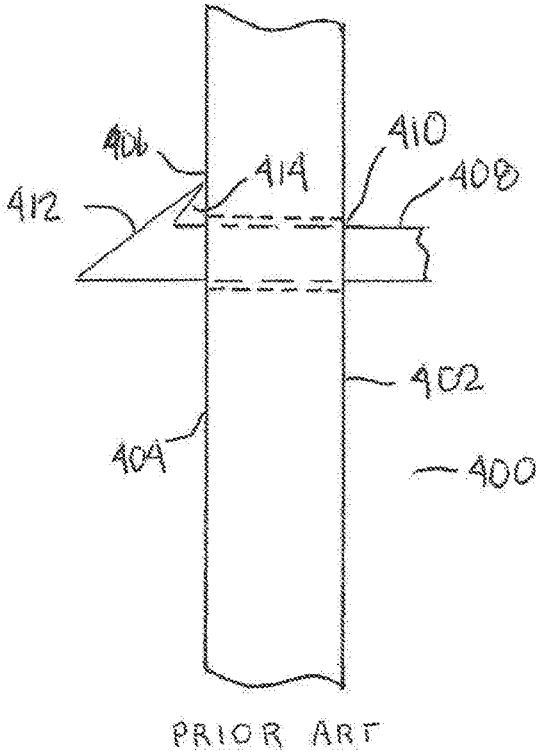
FIG. 4A shows an engagement mechanism of the Prior Art for engaging a horizontal rail with a picket post.
Figure 4B:
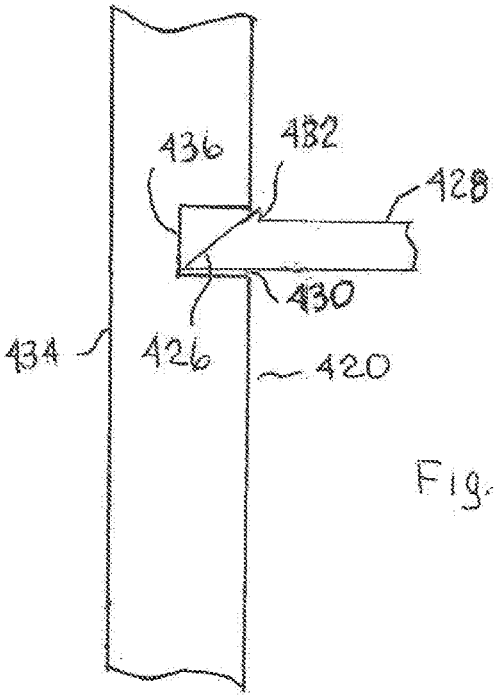
FIG. 4B shows a first engagement mechanism of the present invention for engaging a horizontal rail with a picket post.
Figure 4C:
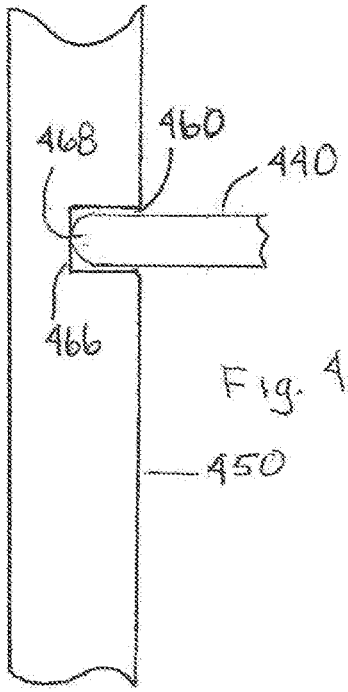
FIG. 4C shows a second engagement mechanism of the present invention for engaging a horizontal rail with a picket post.

FIG. 4A shows an engagement mechanism of the Prior Art (e.g., U.S. Pat. No. 8,511,648, McCarthy) for engaging a horizontal rail (not shown, but attached to a distal end (not shown) of the barbed post 408 with a picket post 402. A slot 410 passes through the entire thickness of the wall of the picket post 402 to enable the forward-most end 412 of the barbed post 408 to pass through the wall of the picket post 402 so that the barb 406 impinges on the interior surface 404 of the wall of the picket post 402, such that any force attempting to withdraw the barbed post 408 will be resisted by the barb 406 latched against the interior surface 404 of the wall of the picket post 402. This locking mechanism is not desired when there is to be a fence repair. Any withdrawal forces applied must be sufficient to damage the barbed post 408 and requires great force which could also damage the downward walls of the picket post 402. The barb tip 414 is flexible to allow the barb tip 414 to bend, allowing passage through the slot 410.

FIG. 4B shows a first engagement mechanism 420 of the present invention for engaging a horizontal rail with a picket post 428. The tip 426 of the post 428 is shown as pointed, but may be flat or rounded. A back tip 432 of a guiding slope to facilitate guiding the post 428 into the groove 430 is shown. The back tip 432 may be pointed or rounded and may be as long as the barb element 414 in FIG. 4A. The back tip need not penetrate into the groove 430, and if it did, it would never latch onto the back or interior surface 434 of the picket post. If the back tip 432 were a long and flexible as the barb tip 414 in FIG. 4A, it would still not have to, and desirably the barb 406 would not, fully penetrate into the groove 410. When partially inserted, a flexible barb 406 would actually offer some force pressing the post 408 out of the groove 430, which would not be harmful in the present invention as the elastic memory from the downward sides (not shown, but explained in FIGS. 3 and 3A) would easily overcome that removing force. Even if the tip (like that 414 of FIG. 4A) were fully enclosed within the groove 430, the tip would be incapable of resisting withdrawal by any force of the tip against the interior surface 434 of the horizontal sidewalls of the picket post.

FIG. 4C shows a second engagement mechanism 450 of the present invention for engaging a horizontal rail with a picket post 440. The tip 468 is shown as a rounded end (flat or pointy is also acceptable) and no reverse sloped element that might act like a barb. The post 440 is inserted fully into the groove 460 so that the elastic memory of the vertical sidewalls of the horizontal rails (not shown) forces the posts into the groove so that the force of the tip 468 against the base surface 466 of the groove supports the tip. The horizontal rails may be easily disassembled from the picket posts by forcing the opposed sidewalls of the horizontal rails apart (e.g., by manual force) and withdrawing the posts 440 from the groove 460. Neither the posts 440, the tips 468, the groove 460 nor the sidewalls of the horizontal rails are likely to be damaged by this action. Individual broken elements (rails or pickets) can be readily replaced, as opposed to the prior art systems where a barb must be removed to disengage components, and the barbs are designed to lock elements into place.

Figure 4D:
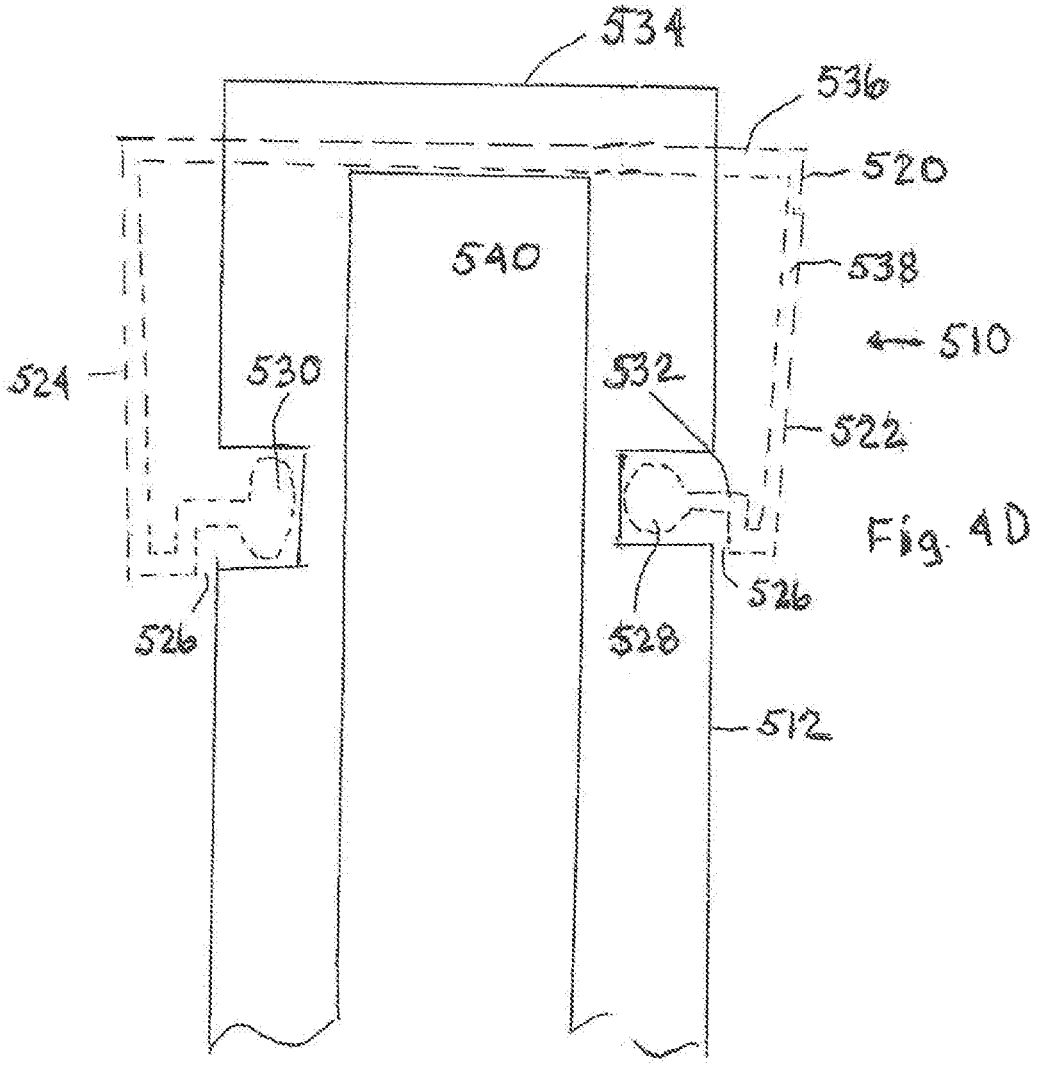
FIG. 4D shows two additional alternative engagement mechanisms of the present invention in a fence system.

FIG. 4D shows two additional alternative engagement mechanisms of the present invention in a fence system 510. The picket post 534 is shown having passed through the top side 536 of the horizontal rail 538. The downward arms 522 and 524 of the horizontal rail are shown slanted inward. At the base of each arm 522 and 524 is an optional abutment barrier 526. The arms respectively have stems 532 and 530 which carry tip elements 528 (round) and 530 (optionally oval) as examples of smooth surface, curved shape tip elements (the tip itself may be round) that can penetrate the grooves and abut against a base surface. The tips do not penetrate into the cavity 540 within the horizontal rails. The corner between the top side 536 and the slanting downward arm 522 is shown as a sharp angle, but may also be a curve.

The grooves need not form holes through the surfaces of the picket posts and preferably do not form openings but only surface grooves. If the posts are long enough, the tips will contact the base surface. The force on the posts is primarily created by elastic memory in the first and second vertical rail sidewalls. The sidewalls may be angled, curved or otherwise formed so that the posts are positioned against the entrance to the grooves, the posts are forced into the grooves.

Figure 5C:
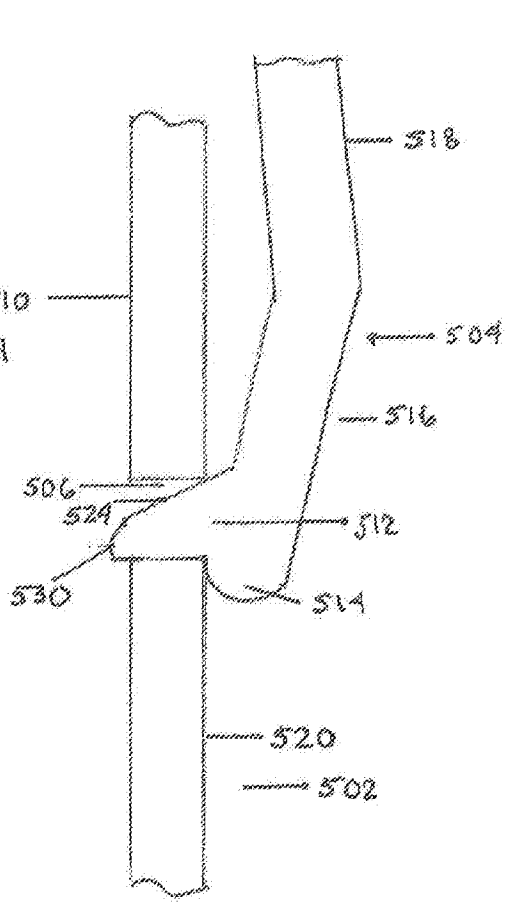
FIG. 5C shows a side cutaway view of a third non-barbed alternative side wall and penetration arm extending from a vertical side of the horizontal railing.
Figure 5B:
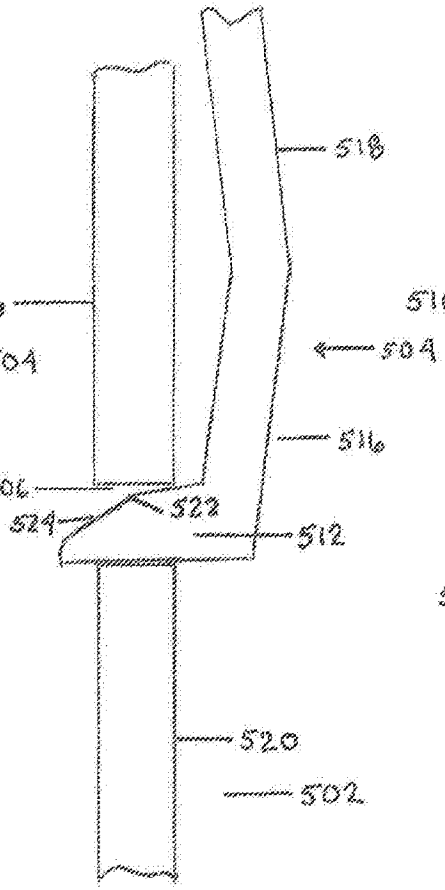
FIG. 5B shows a side cutaway view of a second non-barbed alternative side wall and penetration arm extending from a vertical side of the horizontal railing.
Figure 5A:
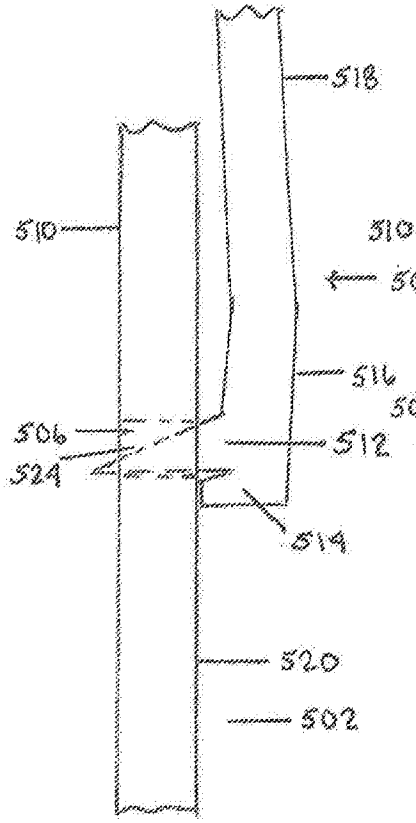
FIG. 5A shows a side view of a first non-barbed alternative side wall and penetration arm extending from a vertical side of the horizontal railing.

FIG. 5A shows a side view of a first non-barbed alternative side wall 520 and penetration (penetrating) arm 512 extending from a vertical side of the horizontal railing 504. The penetrating arm 512 with a sloped front 504 to ease penetration/insertion into a hole 506 in the vertical side of the horizontal picket 520 from the horizontal rail 504. The base of the penetrating arm 512 has a bump/bubble/extension 514 that limits the possible penetration of the penetration arm 512 into the hole 506 in the vertical side of the horizontal picket 520 from the horizontal rail 504. The most forward end of the penetration arm 512 may or may not be exposed through the hole 506 in the vertical side of the horizontal picket 520 from the horizontal rail 504. The bend or curve formed by an upper 518 and lower 516 segment of the horizontal rail 504 is shown. It is that curve or bend that can assist in providing tension in the penetrating arm 512 into the hole 506 with possible pressure from the penetration limiting bump/bubble/extension 514 pressing against an exterior surface 502 of the picket to prevent any contact by any part of the penetrating arm 512 against the inner surface 510 of the vertical side wall 520 of the picket.

FIG. 5B shows a side cutaway view of a second non-barbed alternative side wall and penetration arm extending from a vertical side of the horizontal railing where all similar numbers are similar elements, even though shapes may change. In FIG. 5B, the sloped front 504 of the is shown with a transition point 522 in the slope, as provided by a bevel in the sloped front 504.

FIG. 5C shows a side cutaway view of a second non-barbed alternative side wall and penetration arm extending from a vertical side of the horizontal railing, where all similar numbers are similar elements, even though shapes may change.

Figures 5D, 5E:
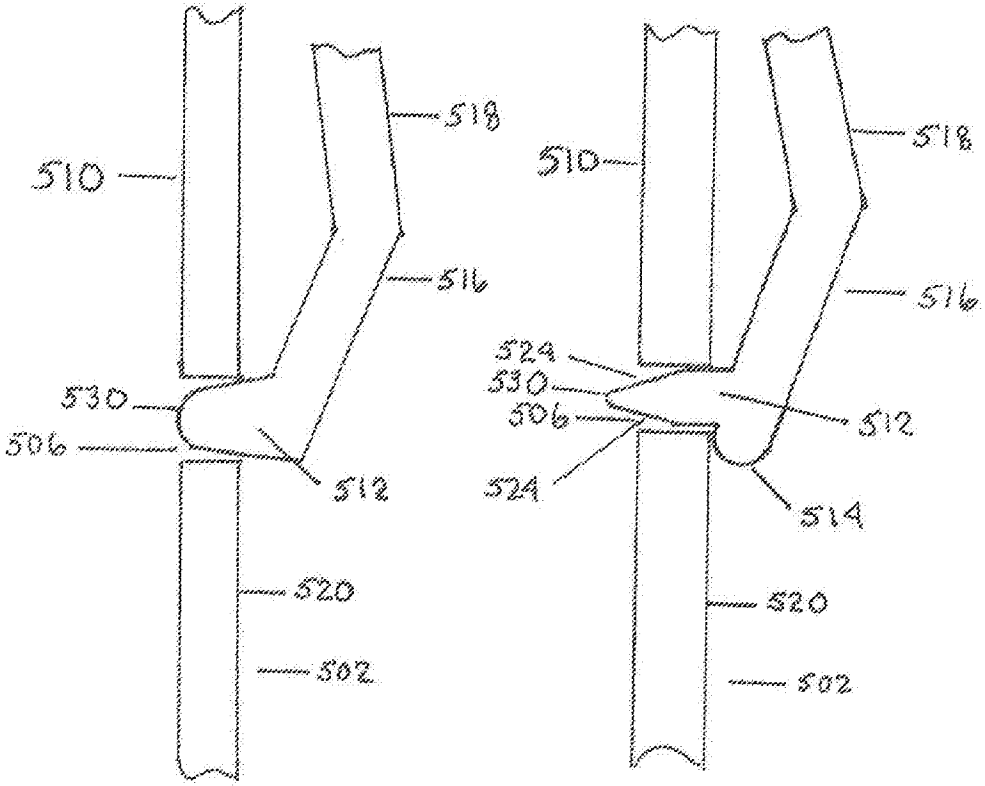
FIG. 5D shows a side cutaway view of a fourth non-barbed alternative side wall and penetration arm with slopes on top and bottom of the tip of the arm, and extending from a vertical side of the horizontal railing.
FIG. 5E shows a side cutaway view of a fifth non-barbed alternative side wall and penetration arm with slopes on top and bottom of the tip of the arm, and extending from a vertical side of the horizontal railing.

FIG. 5D shows a side cutaway view of a fourth non-barbed alternative side wall 504 and penetration arm 512 with slopes 524 on top and bottom of the tip 530 of the arm, and extending from a vertical side 504 of the horizontal railing (not shown in its entirety. The slopes 524 on the top and bottom of the arm 512 extending to the tip 530 prevents the arm from any significant contact with interior edges on the hole 506 from contacting the inner surface 510 of the picket vertical face 520. It is therefore impossible for any part of the arm 512 from abutting against the interior surface 510. The tip 530 does not even have to cut across the plane of the inner surface 510.

FIG. 5E shows a side cutaway view of a fifth non-barbed alternative side wall 504 and penetration arm 512 with slopes 524 on top and bottom of the tip 530 of the arm, and extending from a vertical side 504 of the horizontal railing (not shown in its entirety). The slopes 524 on the top and bottom of the arm 512 extending to the tip 530 prevents the arm from any significant contact with interior edges on the hole 506 from contacting the inner surface 510 of the picket vertical face 520. It is therefore impossible for any part of the arm 512 from abutting against the interior surface 510. The tip 530 does not even have to cut across the plane of the inner surface 510.

In both FIGS. 5D and 5E, the fence system is shown wherein the posts slope away from interior sides of the hole at the tip of the post so that an end of the arm proximal to the inner surface of the picket has a smaller cross-section than an end of the arm distal from the inner surface of the picket.

Although specific examples have been given in the description above, one skilled in the art will appreciate the generic disclosure herein and the claims will be equivalently interpreted with an understanding of equivalents known to those skilled in the art.

What is claimed:

1. A fence system comprising: at least two engaging elements, an upper horizontal rail and a lower horizontal rail extending along respective upper and lower rail axes; each of the upper horizontal rails and the lower horizontal rail has a respective extended plastic material including a horizontal top wall extending laterally between first and second vertical rail sidewalls that depend downwardly from opposed edges of the top wall to define an internal cavity; at least two attachment legs each extend inwardly towards each other from a lower portion of the sidewalls, and each attachment leg including a post having a tip; a plurality of vertical picket posts extend between through holes in the upper and lower horizontal rails; each picket post includes at least one inner groove and at least one outer groove on opposed exterior surfaces of the picket posts, each groove comprising a hole through respective opposed exterior surfaces; and the grooves receive the posts which penetrate an internal cavity within the vertical picket posts; wherein the posts are forced inwardly into the grooves by elastic memory in the sidewalls, the posts within grooves being in an extractable and unlocked engagement within the grooves, but held in place by the force of the elastic memory, the posts extractable from the grooves by overcoming the elastic force.

2. The fence system of claim 1, wherein the vertical rail sidewalls are bowed so that the posts are positioned towards each other at bottoms of the attachment legs.

3. The fence system of claim 2 wherein there is at least one upwardly or downwardly reversing slope from each tip that assists in guidance of the posts into the grooves.

4. The fence system of claim 3 wherein the at least one slope has a length to its end away from the tip so that when the tip passes through the groove, an end of the slope away from the tip extends contact an exterior edge of the groove.

5. The fence system of claim 2 wherein there is at least one upwardly or downwardly reversing slope from the tips that assists in guidance of the posts into the grooves, and the slope has a bevel therein.

6. The fence system of claim 5 wherein the at least one slope has a length to its end away from the tip so that when the tip passes through the groove, an end of the slope away from the tip extends contact an exterior edge of the groove.

7. The fence system of claim 6 wherein withdrawal of the posts from the grooves can be accomplished by overcoming only the elastic memory and incidental friction between the posts and interior surfaces of the grooves.

8. The fence system of claim 1, wherein bottoms of the vertical rail sidewalls are slanted inwardly so that the posts are positioned towards each other on the attachment legs.

9. The fence system of claim 8 wherein there is at least one upwardly or downwardly reversing slope from the tips that assists in guidance of the posts into the grooves.

10. The fence system of claim 9 wherein the at least one slope has a length to its end away from the tip so that when the tip passes through the groove, an end of the slope away from the tip extends contact an exterior edge of the groove.

11. The fence system of claim 10 wherein withdrawal of the posts from the grooves can be accomplished by overcoming only the elastic memory and incidental friction between the posts and interior surfaces of the grooves.

12. The fence system of claim 1 wherein there are no one upwardly or downwardly reversing slopes from each tip.

13. The fence system of claim 1 wherein withdrawal of the posts from the grooves can be accomplished by overcoming only the elastic memory and incidental friction between the posts and interior surfaces of the grooves.

14. A method of assembly a readily disassemblable fence system comprising a) at least three engaging elements, an upper horizontal rail and a lower horizontal rail extending along respective upper and lower rail axes, and each of the upper horizontal rails and the lower horizontal rail having through holes; and b) at least one vertical picket post that is sized to extend between the through holes in the upper and lower horizontal rails; each of the upper horizontal rails and the lower horizontal rail has a respective extended plastic material including a horizontal top wall extending laterally between first and second vertical rail sidewalls that depend downwardly from opposed edges of the top wall to define an internal cavity, and at least two attachment legs each extend inwardly towards each other from a lower portion of the sidewalls, and each attachment leg including a post having a tip; inserting the at least one vertical picket post so that the at least one vertical picket post extends between both of the through holes in the upper horizontal rails and the lower horizontal rails; each picket post includes at least one upper groove and at least one lower groove on opposed exterior surfaces of the picket posts; aligning the posts on at least one of the first and second vertical side walls so that grooves receive the posts without penetration into any internal cavities of the upper and lower rail; and forcing the posts inwardly into the grooves by elastic memory in the sidewalls, the posts within grooves slidable out of the grooves and not being in any locked engagement with the grooves, being held in place by the force of the elastic memory and being withdrawable from the grooves by overcoming the elastic force.

15. The method of claim 14, wherein the vertical rail sidewalls are bowed and the posts are positioned towards each other at bottoms of the attachment legs.

16. The method of claim 14, wherein bottoms of the vertical rail sidewalls are slanted inwardly and the posts are positioned towards each other on the attachment legs by the inward slant.

17. The method of claim 14 wherein there are no one upwardly or downwardly reversing slopes from the tips.

18. The method of claim 14 wherein after assembling the fence system, the at least one vertical post is separated from at least one of the horizontal rails by a force overcoming inwardly stabilizing elastic memory and removing the posts from the grooves without damaging the posts.

19. A fence system comprising: at least two engaging elements, an upper horizontal rail and a lower horizontal rail extending along respective upper and lower rail axes; each of the upper horizontal rails and the lower horizontal rail has a respective extended plastic material including a horizontal top wall extending laterally between first and second vertical rail sidewalls that depend downwardly from opposed edges of the top wall to define an internal cavity; at least two attachment legs each extend inwardly towards each other from a lower portion of the sidewalls, and each attachment leg including a post having a tip; a plurality of vertical picket posts extend between through holes in the upper and lower horizontal rails; each picket post includes at least one inner groove and at least one outer groove on opposed exterior surfaces of the picket posts; the grooves receive the posts without penetration by the post into any internal cavities of the upper and lower rail; the grooves have a base surface within the grooves, and the tips of the posts extend towards or into contact with the base surface; the posts are forced inwardly into the grooves by elastic memory in the sidewalls, the posts within grooves being in an extractable and unlocked engagement within the grooves, but held in place by the force of the elastic memory, the posts withdrawable from the grooves by overcoming the elastic force.

20. The fence system of claim 19 wherein the posts slope away from interior sides of the hole at the tip of the post so that an end of the arm proximal to the inner surface of the picket has a smaller cross-section than an end of the arm distal from the inner surface of the picket.

* * * * *